US005497533A

United States Patent [19]

Karlsen

[11] Patent Number: 5,497,533

[45] Date of Patent: Mar. 12, 1996

[54] SURFACE MOUNTED DOOR CLOSER HOUSING RESISTANT TO VANDALISM

[75] Inventor: Erik Karlsen, Bronx, N.Y.

[73] Assignee: Vandal Proof Mfg. Inc., Staten Island, N.Y.

[21] Appl. No.: 281,845

[22] Filed: Jul. 28, 1994

[51] Int. Cl.[6] ..... E05F 1/00

[52] U.S. Cl. ..... 16/71; 16/49

[58] Field of Search ..... 16/49, 63–65, 16/71, 78, 79, 68–70, 72, 50–52; 49/340

[56] References Cited

U.S. PATENT DOCUMENTS

| | | | |
|---|---|---|---|
| 2,772,439 | 12/1956 | Flint | 16/49 |
| 3,787,924 | 1/1974 | Jentsch | 16/49 |
| 4,160,304 | 7/1979 | Smith et al. | 16/49 |
| 4,763,384 | 8/1988 | Watabe | 16/65 |

FOREIGN PATENT DOCUMENTS

| | | | |
|---|---|---|---|
| 3202198 | 8/1983 | Germany | 16/49 |

*Primary Examiner*—Mark Rosenbaum
*Assistant Examiner*—Kenneth J. Hansen
*Attorney, Agent, or Firm*—Ostrolenk, Faber, Gerb & Soffen

[57] ABSTRACT

Surface mounted apparatus for closing a door that is hinged along a side thereof includes a commercially available spring powered closer unit that is mounted within a heavy duty outer housing secured directly on the door. A pivoted linkage is connected between the closer unit and a bracket secured directly on a door jamb. The linkage is constructed of heavy duty arms and pivot pins are mounted permanently as by welding. A stub shaft on the linkage extends through a tiltable bearing unit into the outer housing to engage the output shaft of the closer unit. Extensive use is made of tamper resistant fasteners to secure elements together and to mount the outer housing and the bracket.

19 Claims, 4 Drawing Sheets

FIG. 3
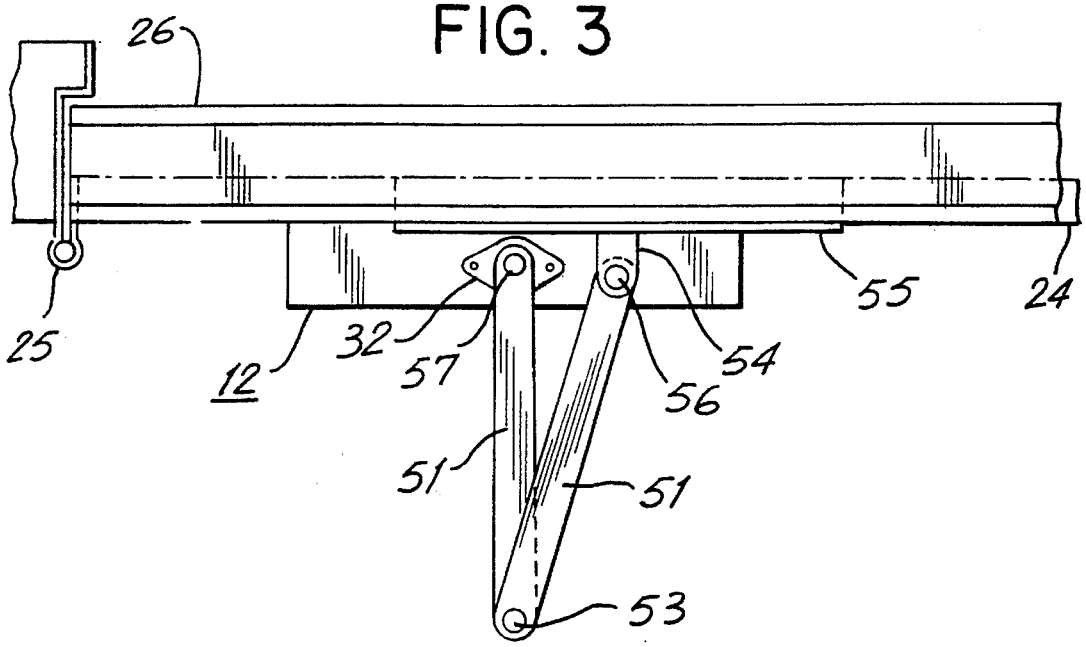
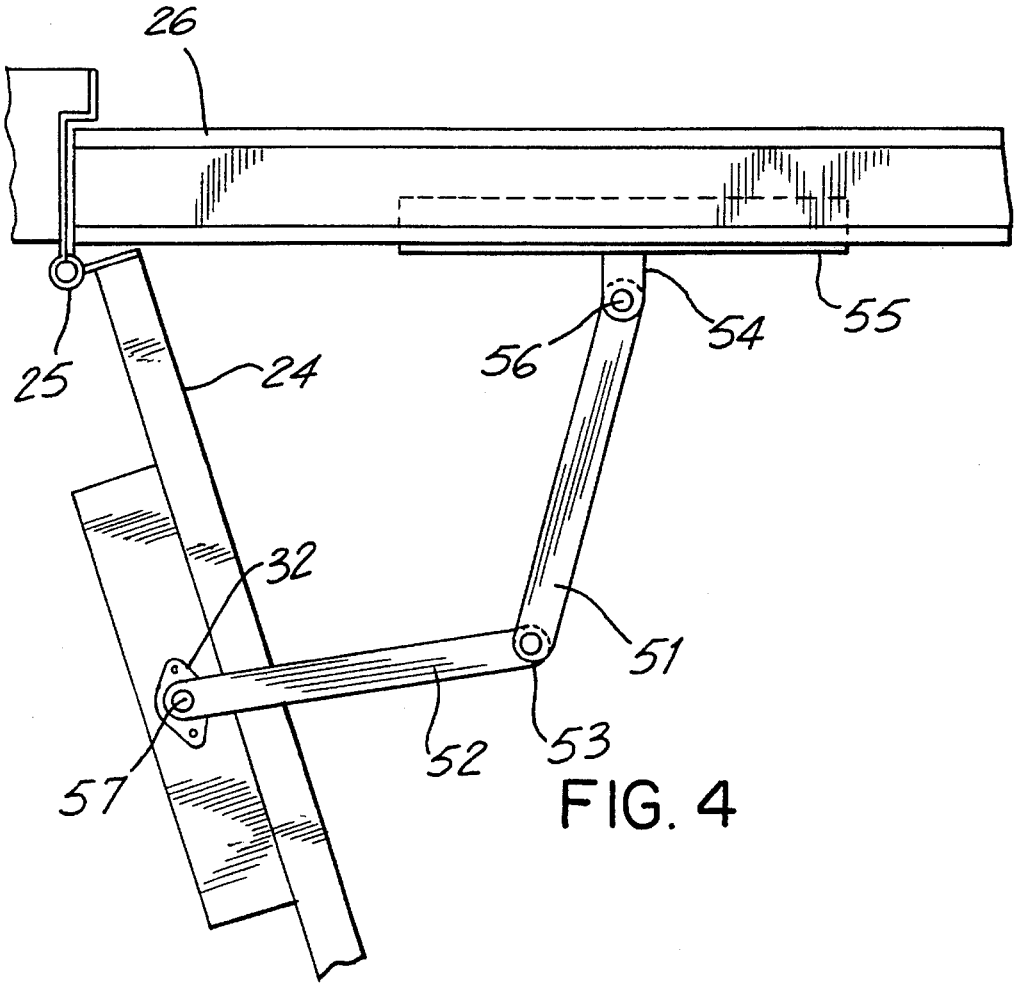
FIG. 4

SURFACE MOUNTED DOOR CLOSER HOUSING RESISTANT TO VANDALISM

BACKGROUND OF THE INVENTION

This invention relates to door closer apparatus in general and more particularly relates to surface mounted door closer apparatus that are resistant to vandalism.

Wall openings through which people enter and exit secured and/or limited access areas of buildings are normally provided with hinged doors that are closed by adjustable and variable spring loaded mechanisms. Examples of suitable mechanisms are door closer units that include spring loaded mechanisms of the type disclosed in U.S. Pat. No. 3,911,527 issued Oct. 14, 1975 to T. R. Lasier for a Spring Adjustment Mechanism and in U.S. Pat. No. 4,019,220 issued Apr. 26, 1977 to S. Lieberman for a Piston Assembly for Door Closer. Such closer units function to bias a door closed and to control the speed at which the door moves to its closed position.

A closer unit and its associated linkage are connected between a door and the door frame or jamb at the wall opening that is closed by the door. When the closer unit is mounted on the door, one end of the linkage is pivotally connected to the frame, and when the closer unit is mounted on the frame one end of the linkage is pivotally connected to the door.

Generally a closer unit will move the door slower as it approaches its closed position and when at a nearly closed position a surge of energy is released to continue moving the door in its closing direction. This surge of energy overcomes forces of a latching mechanism that holds the door locked in its fully closed position.

Door closer units and their associate linkages are often subjected to vandalism. Sometimes the vandals steal the closer units, but more often the vandals are seeking immediate entrance to the limited access area for illegal purposes. Once vandals have opened a door to a secured area, they take steps to insure that the door does not close fully and become latched closed. This can be accomplished by disabling the linkage, as by distorting elements thereof to the extent that the closer apparatus is unable to move the door to its fully closed position.

SUMMARY OF THE INVENTION

In order to inhibit vandals from stealing and/or dismounting door closer elements from a door and/or a door jamb, and in order to inhibit vandals from damaging the closer unit and/or its connected linkage, the instant invention provides a heavy duty tamper proof construction for a closer unit housing and the linkage connected to the closer unit. In particular, according to the instant invention the linkage and bracket to which it is connected are both constructed of heavy duty elements that are connected, even at pivot joints, in a permanent manner, as by welding.

Tamper proof fasteners (screws that require special tools) are used extensively and the mounting bracket at one end of the mechanism is formed by an elongated member shaped similar to an angle iron. The latter is secured in operative position by a first plurality of fasteners which extend through one arm of the bracket and a second plurality of fasteners that extend through the other arm of the bracket. Screws of the first and second pluralities are at right angles to each other, so that a force that is directed axially with respect to the first plurality of fasteners with the intent of ripping them out of a mounting member into which they have been driven must also act to shear the second plurality of fasteners. A much greater force is required to shear a fastener than to rip same from a mounting member.

The spring powered closer unit is a commercially available product, and in accordance with the instant invention is mounted within a heavy duty outer housing rather than behind a relatively fragile outer cover as provided by the prior art for aesthetic reasons. A stub shaft at one end of the linkage enters the outer housing through a tiltably mounted bearing unit to engage and be secured to the output shaft of the closer unit. The ability of the bearing unit to tilt is achieved by a universal joint design that is weather tight and provides tolerance for less than perfect alignment between the door mounted and jamb mounted elements of the closer apparatus to reduce strain on the closer unit.

Accordingly, a primary object of the instant invention is to provide a novel improved construction for a vandal resistant surface mounted door closer apparatus.

Another object is to provide closer apparatus of this type in which a commercially available spring powered closer unit is mounted within a heavy duty outer housing.

Still another object is to provide closer apparatus of this type wherein life of the spring powered closer unit is increased by providing the outer housing with a tiltable bearing unit through which a linkage projection extends to engage the output shaft of the closer unit.

Yet another object is to provide closer apparatus of this type that includes a pivoted heavy duty linkage and mounting bracket that are connected together in a permanent manner to resist bending and/or dismantling.

A further object is to provide closer apparatus of this type which makes extensive use of tamper resistant fasteners for securing apparatus elements to one another as well as to secure elements of the apparatus to a door and door frame.

A still further object is to provide closer apparatus of this type in which an angle iron is utilized as a bracket for mounting the apparatus to a door or its associated door jamb.

BRIEF DESCRIPTION OF THE DRAWINGS

The foregoing objects as well as other objects of this invention shall become readily apparent after reading the following description of the accompanying drawings in which:

FIGS. 3 and 4 are plan views of the elements of FIG. 1. In FIG. 3 the door to a secured area is closed and in FIG. 4 this door is open.

DETAILED DESCRIPTION OF THE INVENTION

Figure 1:
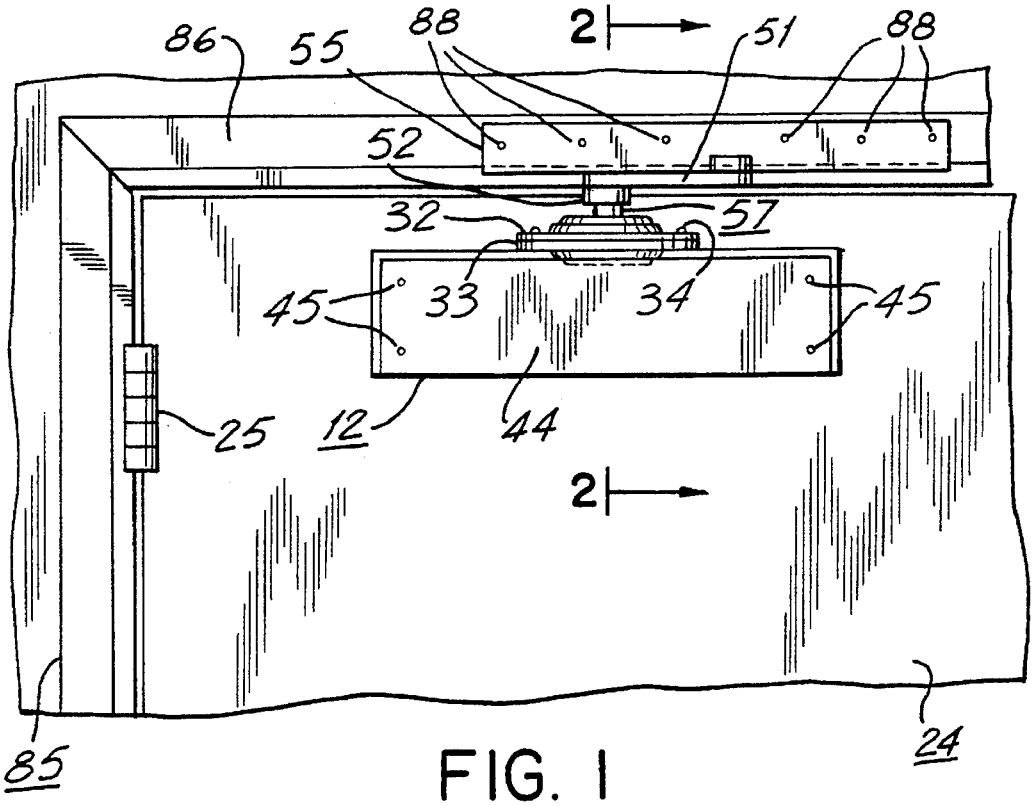
FIG. 1 is a front elevation of surface mounted door closer apparatus constructed in accordance with teachings of the instant invention and mounted under operating conditions.
Figure 2:
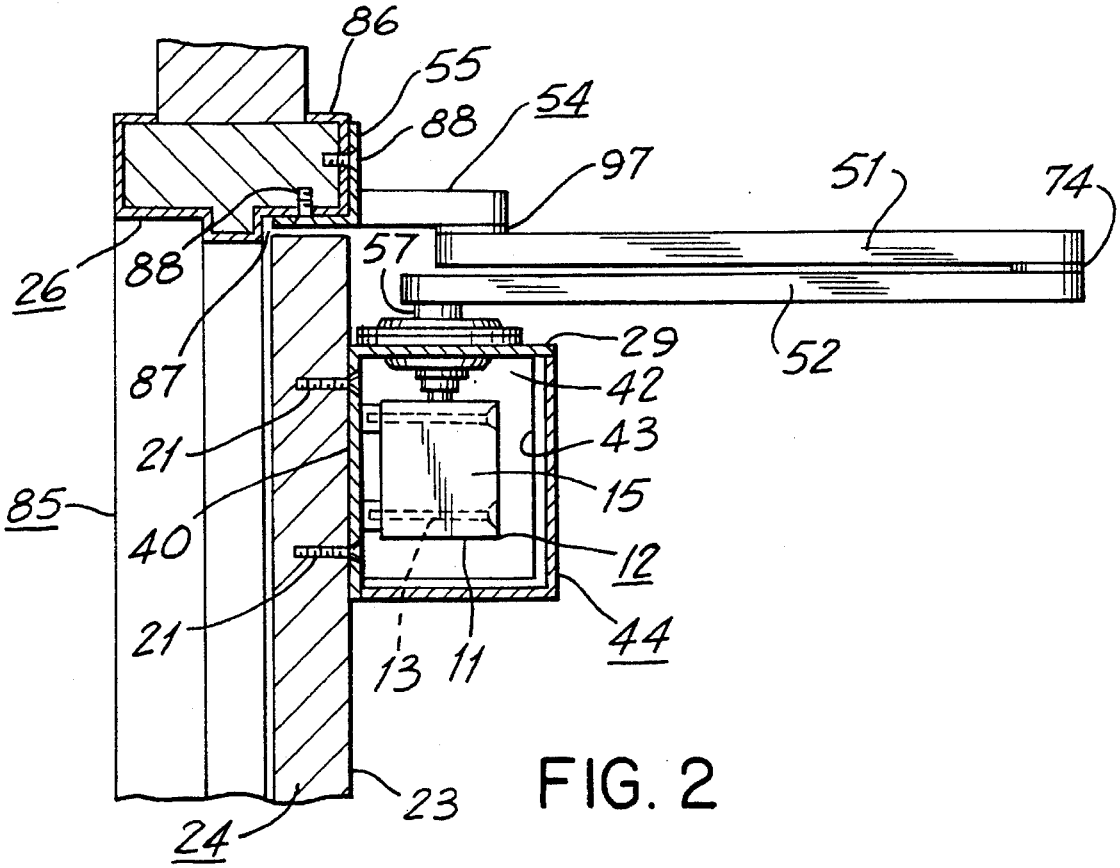
FIG. 2 is a cross-section taken through line 2—2 of FIG. 1 looking in the direction of arrows 2—2.
Figure 5:
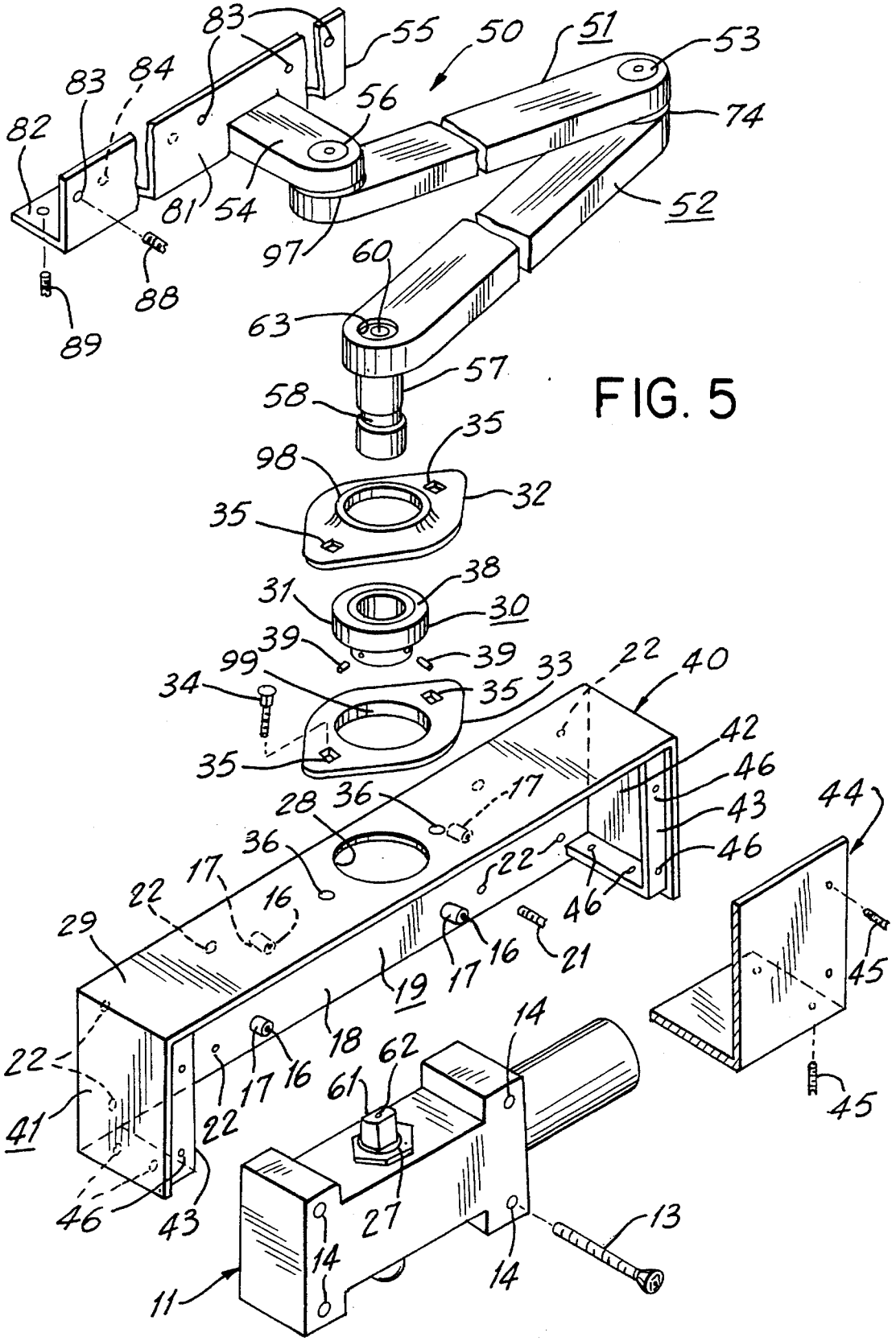
FIG. 5 is an exploded perspective of the surface mounted door closer apparatus.

Now referring to the Figures, commercially available spring powered door closer unit 11, of a type disclosed in the aforesaid U.S. Pat. Nos. 3,911,527 and 4,019,220, is disposed within heavy duty rectangular outside housing 12, being secured in place by four tamper resistant machine screws 13. The latter extend through bores 14 in closer housing 15 and are received by threaded apertures 16 in bosses 17 on the front surface 18 of outer housing rear wall 19. A plurality of tamper resistant screws 21, each extending through an individual aperture 22 of wall 19, secure outer housing 12 to front surface 23 of door 24 close to the upper edge of the latter. Door 24 is connected by a plurality of side hinges 25 to frame or jamb 26 that defines an opening to a secured or limited access area, which opening is normally closed by door 24.

Figure 6:
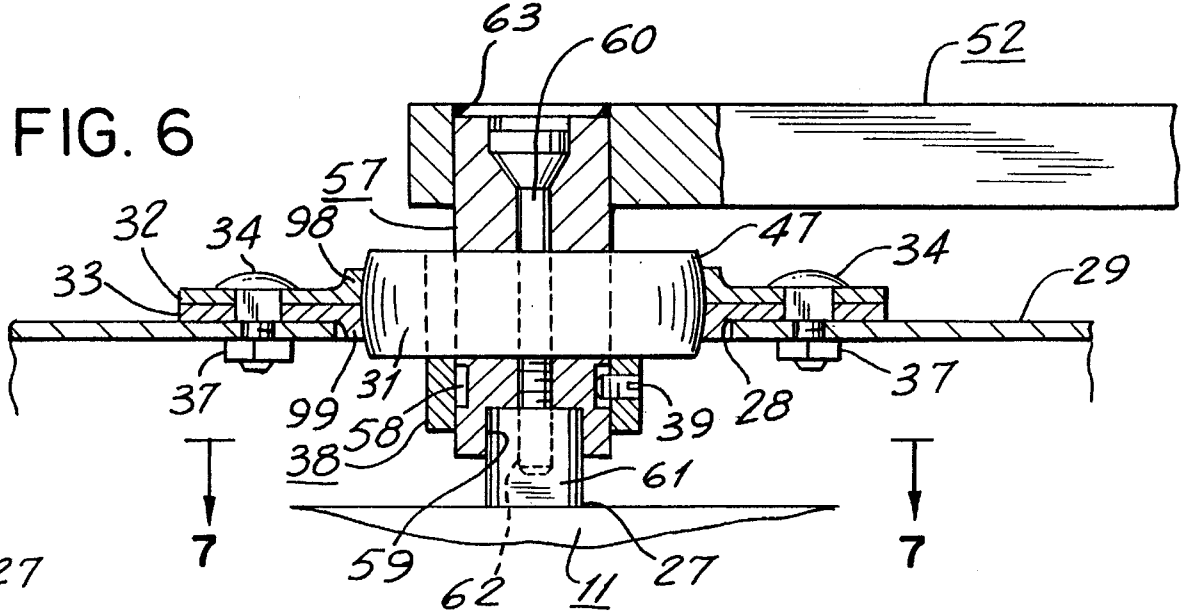
FIG. 6 is a partially sectioned detail of the apparatus elements in the region where the linkage enters the heavy duty outer housing.

Upwardly extending output shaft 27 of closer unit 11 is aligned with large central aperture 28 in top wall 29 of outer housing 12. Disposed at aperture 28 is a weather proof universal joint assembly that includes sleeve unit 30 having outer ring 31 that is surrounded and engaged by a pair of annular lips 98, 99 that protrude in opposite directions from face to face retainers 32, 33. A pair of carriage bolts 34 extend through aligned square apertures 35 in retainers 32, 33 and a pair of round apertures 36 in top wall 29. Nuts 37 on the inside of housing 12 threadably engage the free lower ends of carriage bolts 34 to secure retainers 32, 33 to wall 29. Ring 31 surrounds the upper end of bearing unit sleeve 38 and the lower end of sleeve 38 extends below ring 31. As seen best in FIG. 6, outer sidewall 47 of ring 31 is crowned and is engaged by complementary inner surfaces of annular lips 98, 99 which are the boundaries for central apertures through retainers 32, 33. A universal joint is formed through the cooperation of lips 98, 99 with sidewall 47. Two radially extending set screws, displaced by 90° from each other are mounted on sleeve 38 below ring 31. Sleeve 38 is rotatable with respect to ring 31 and there is a packing element (not shown) interposed between elements 31 and 38 to block liquid from entering outer housing 12 by flowing between elements 31 and 38.

Rear wall 19 and top wall 29 are parts of main housing section 40 which also includes end walls 41, 42 having recessed L-shaped ledges 43 along their front and bottom edges. Outer housing 12 also includes L-shaped cover 44 secured to main section 40 by eight tamper resistant screws 45 that are received by tapped apertures 46 in ledges 43.

The remaining elements of the door closer apparatus are permanently secured to one another to form assembly 50 which includes upper and lower linkage arms 51, 52 that are pivotally connected by pin 53, stub arm 54 that is welded to bracket 55 projecting forward from vertical leg 81 of bracket 55, pin 56 that pivotally connects the forward end of stub arm 54 with the end of upper arm 51 remote from pivot pin 53, and stub shaft 57 which is rigidly secured to and projects downward from lower arm 52 at the end thereof remote from pivot pin 53.

Below arm 52, stub shaft 57 is provided with annular recess 58 which is disposed to receive set screws 39 when assembly 50 is operatively engaged with closer unit 11. Stub shaft 57 extends through sleeve 38, with keying recess 59 at the lower end of shaft 57 receiving the upwardly extending keyed portion 61 of output shaft 27 to form a driving connection between closer unit 11 and assembly 50. Tamper resistant screw 60 extends downwardly through a central bore in stub shaft 57 and is received by threaded aperture 62 that extends downwardly from the upper end of output shaft 27. With closer unit 11 mounted within outer housing 12, in order to be able to separate stub shaft 57 from output shaft 27 to break the driving connection therebetween, screw 60 must be in its releasing position disengaged from the threads in aperture 62 and set screws 39 must be in their releasing condition backed out of recess 58.

Recessed weld 63 at the upper end of stub shaft 57 provides a permanent driving connection between elements 52 and 57 whereby torque transmitted through lower arm 52 from closer unit 11 is transmitted to linkage 51, 52.

Figure 8:
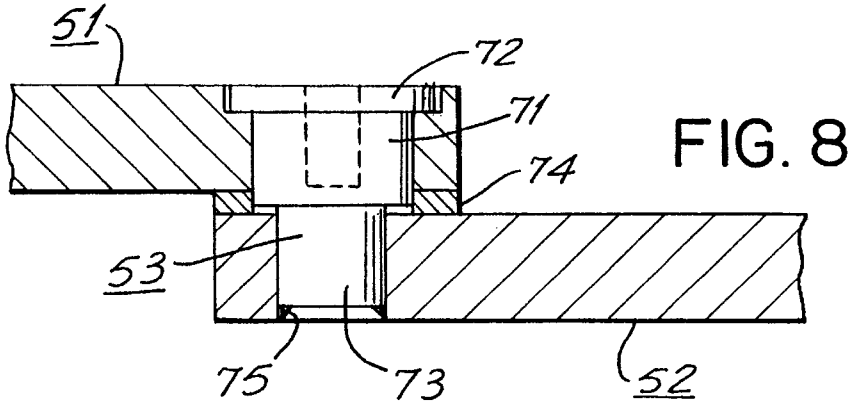
FIG. 8 is a fragmentary cross-section detailing the pivotal connection between the arms of the linkage.
Figure 7:
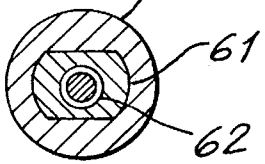
FIG. 7 is a cross-section taken through line 7—7 of FIG. 6 looking in the direction of arrows 7—7.

As seen in FIG. 8, pivot pin 53 includes mid section 71, enlarged head 72 above mid section 71 and reduced diameter lower section 73. Head 72 and mid section 71 are received by complementary portions of an aperture which extends through upper arm 51. The lower end of mid section 71 is surrounded by washer 74 that is interposed between linkage arms 51, 52 and lower section 73 of pin 53 is disposed within a complementary aperture of lower arm 52. The lower end of pivot pin 53 is positioned slightly above the lower surface of lower arm 52 to provide a shallow recess wherein weld 75 is disposed. The latter provides fixed securement of pivot pin 53 to lower arm 52.

Washer 97 surrounds pivot pin 56 and is disposed between the upper surface of upper arm 51 and the lower surface of stub arm 54. Pins 53 and 56 are essentially the same shape and are mounted in essentially the same manner, so that there is a fixed connection between pivot pin 56 and upper arm 51 and a pivotal connection between pin 56 and stub arm 54.

Bracket 55 is an elongated piece of stainless steel bent to form horizontal leg 82 and vertical leg 81. The latter is disposed along the front edge of horizontal leg 82. Vertical leg 81 is provided with a plurality of clearance apertures 83 and horizontal leg 82 is provided with a plurality of clearance apertures 84. Bracket 55 is operatively mounted with its vertical leg 81 abutting forward surface 86 of door jamb 26 to which door 24 is pivotally mounted by side hinges 25, and lower leg 82 of bracket 55 abuts lower horizontal surface 87 of jamb 26. A plurality of tamper resistant screws 88 extend through clearance apertures 83 and secure bracket 55 to jamb surface 86 while another plurality of tamper resistant screws 89 extend through apertures 84 to secure bracket 55 to jamb surface 87.

Figure 9:
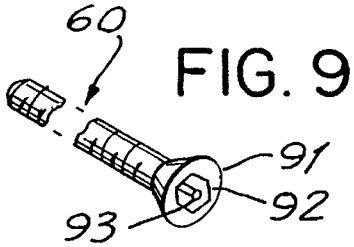
FIG. 9 is an enlarged perspective looking at the head region of a suitable tamper resistant screw fastener which is used to secure elements of the door closer apparatus together and to mount the door closer apparatus in its operating environment.

While it is not impossible to remove tamper resistant screws, it is an arduous task to do so without a special tool. For example, head 91 of tamper resistant screw 60 in FIG. 9 is provided with hex shaped socket 92 to receive a wrench for tightening and removing screw 60. However, an ordinary hex wrench will not do the job. A special hex wrench, one having a central aperture, must be used in order to provide clearance for blocking pin 93 that is disposed within aperture 92 and extends lengthwise of screw 60 to the free end of head 91.

With outer housing 12 secured to door 24 and bracket 55 secured to door jamb 26 as illustrated in the drawings, pivot 56 at one end of linkage 51, 52 remains fixed as door 24 moves between its closed position of FIG. 3 and its open position of FIG. 4. During this motion, shaft 57 at the other end of linkage 51, 52 is constrained to move in a circular path about door hinges 25 as a center and shaft 57 also pivots on its vertical axis in accordance with the relative lengths of linkage arms 51, 52 and the spacing between pivot 56 and shaft 57. Thus, as door 24 is opened, shaft 57 is forced to pivot counterclockwise about its vertical axis as viewed in FIGS. 3 and 4. In so doing, shaft 57 pivots output shaft 27 of closer unit 11 to load or energize the springs (not shown) of closer unit 11. Now when door 24 is released, closer unit has sufficient energy to fully close door 24 and cause its latching mechanism (not shown) to engage and thereby lock door 24 closed.

Preferably, heavy duty outer housing 12 and bracket 55 are constructed of material having strength properties of 10 gauge stainless steel and each of the linkage arms 51, 52 is constructed of material having the strength properties of stainless steel that has a ½ inch by 1½ inch wide cross-section.

While the embodiment illustrated in the drawings and described above includes a common door closing linkage having two movable arms, it should now be apparent to those skilled in the art that the subject invention can be carried out by utilizing a linkage having a single movable arm or a linkage having three or more arms.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A housing assembly for a surface mounted apparatus for closing a door that is hinged along a side thereof to a door jamb at an entrance/exit opening in a boundary wall for a restricted area, said housing assembly comprising:

a main housing defining an enclosure for containing a closer unit having an output shaft;

a cover secured to said main housing for enclosing said closer unit and its said output shaft within said main housing;

a bearing unit disposed in an opening in said main housing, and being tiltable with respect to said main housing;

an arm assembly disposed outside said main housing including:

a linkage;

a mounting bracket; and a first pivot connection permanently joined to said bracket and to said linkage; and a driving connection for joining said output shaft with said linkage, said driving connection including a stub shaft rotatably disposed in said bearing unit and tiltable with respect to said main housing, said stub shaft being operatively engageable with said output shaft;

a first fastener device disposed inside of said main housing for contacting said stub shaft to maintain operative engagement between said stub shaft and said output shaft;

said first device being accessible only from within said main housing for operation of said first device to a releasing condition wherein operative engagement between said stub shaft and said output shaft may be broken.

2. The housing assembly as defined by claim 1, further comprising a second device that extends axially through said stub shaft also for maintaining operative engagement between said stub shaft and said output shaft;

said second device being operable to a releasing condition wherein operative engagement between said stub shaft and said output shaft may be broken;

with said closer unit mounted within said main housing, said stub shaft being separable from said output shaft only when both said first and second devices are in their respective releasing conditions.

3. The housing assembly as defined by claim 2, wherein said second device comprises a tamper-resisting screw that extends through an axial passage in said stub shaft and threadably engages in a tapped, axial aperture of said output shaft.

4. The housing assembly as defined by claim 2, wherein said stub shaft is permanently connected to said linkage at a position remote from said first pivot connection and wherein said stub shaft extends into said main housing through an opening thereof and operatively engages said output shaft within said main housing.

5. The housing assembly as defined by claim 4, wherein said stub shaft extends through said bearing unit to engage said output shaft.

6. The housing assembly as defined by claim 5 in which the bearing unit includes a sleeve that defines an axial passage for said stub shaft and a ring surrounding said sleeve;

said ring having a crowned outer surface;

retaining elements cooperating to secure said ring to said outer housing and providing a complementary surface adjacent to said outer surface to permit said bearing unit to tilt relative to said main housing.

7. The housing assembly as defined by claim 5, wherein said second device comprises a tamper-resisting screw that extends through an axial passage in said stub shaft and threadably engages in a tapped, axial aperture of said output shaft.

8. The housing assembly as defined by claim 1, wherein said stub shaft is permanently connected to said linkage at a position remote from said first pivot connection and wherein said stub shaft extends into said main housing through an opening thereof and operatively engages said output shaft within said main housing.

9. The housing assembly as defined by claim 8 wherein:

said bearing unit includes a universal bearing unit mounted to said housing at said opening;

said stub shaft extending through said bearing unit to engage said output shaft.

10. The housing assembly as defined by claim 9, wherein the universal bearing unit includes:

a sleeve that defines an axial passage for said stub shaft;

a ring surrounding said sleeve, said ring having a crowned outer surface; and retaining elements cooperating to secure said ring to said outer housing and providing a complementary surface adjacent to said crowned outer surface to permit said universal bearing unit and said stub shaft to tilt relative to said main housing.

11. The housing assembly as defined by claim 1 in which said linkage includes a first arm, a second arm and a second pivot connection permanently joining said arms to each other.

12. The housing assembly as defined by claim 11 in which the second pivot connection is at an end of said first arm remote from said stub shaft and at an end of said second arm remote from said first pivot connection.

13. The housing assembly as defined by claim 1, wherein a first plurality of tamper-resistant fasteners maintain said cover of said main housing closed, said main housing completely enclosing said closer unit when said cover is closed.

14. The housing assembly as defined by claim 13 wherein:

said cover provides a front wall and a bottom wall of said main housing;

said main housing further includes a rear wall, the rear wall having mounting receptacles disposed thereon inside said housing for mounting said closer unit to said rear wall; and a second plurality of tamper-resistant fasteners for securing said closer unit to said rear wall.

15. The housing assembly of claim 13, wherein said closer unit is accessible only upon removal of said cover.

16. The housing assembly as defined by claim 1 in which said bracket is elongated and includes first and second legs at right angles to each other.

17. The housing assembly as defined by claim 16 in which each of said legs is provided with a plurality of apertures for receiving a plurality of tamper-resisting fasteners that secure said bracket to a mounting member.

18. The housing assembly as defined by claim 17 in which those of said fasteners that extend through the plurality of apertures in said first leg are transverse to those of said fasteners that extend through the plurality of apertures in said second leg.

19. The housing assembly of claim 1, wherein said stub shaft includes an annular recess, and first device comprises set screws to be received in said recess for securing said stub shaft within said bearing.

* * * * *